US005373831A

United States Patent [19]

Cushman

[11] Patent Number: 5,373,831

[45] Date of Patent: Dec. 20, 1994

[54] COMPOUND BOW WITH HIGH POWER AND EXTREME LET-OFF

[76] Inventor: William B. Cushman, 1315 Finley Dr., Pensacola, Fla. 32514

[21] Appl. No.: 70,762

[22] Filed: Jun. 3, 1993

[51] Int. Cl.[5] ..... F41B 5/00

[52] U.S. Cl. ..... 124/25.6; 124/88; 124/23.1

[58] Field of Search ..... 124/23.1, 25.6, 88; 267/158, 151, 152, 164

[56] References Cited

U.S. PATENT DOCUMENTS

| | | | |
|---|---|---|---|
| 428,912 | 5/1890 | Holmes | 124/23.1 |
| 3,486,495 | 12/1969 | Allen . | |
| 3,744,473 | 7/1973 | Nishioka | 124/25.6 |
| 3,812,835 | 5/1974 | Smith . | |
| 4,041,927 | 8/1977 | Van House . | |
| 4,756,295 | 7/1988 | Guzzetta . | |
| 4,989,577 | 2/1991 | Bixby | 124/25.6 |
| 5,165,382 | 11/1992 | Morrison | 124/23.1 |
| 5,248,467 | 9/1993 | Cushman . | |

*Primary Examiner*—Randolph A. Reese
*Assistant Examiner*—Anthony Knight

[57] ABSTRACT

An improved compound bow apparatus with extreme let-off and high power is disclosed. The preferred embodiment of the instant invention is aesthetically improved, has inherently balanced limbs that require no adjustment, and has an improved dynamic balance and center of gravity. These and additional objects of the invention are accomplished by storing energy in a leaf spring energy storage device as the bow of the instant invention is drawn. Energy is stored by rotating bearing surfaces mounted on linkages attached to upper and lower bow limbs into a leaf spring in a manner that causes a portion of the force from the leaf spring which is proportional to the rotation angle to be absorbed as compression by the linkage, with the remainder causing torque on the upper and lower bow limbs. The movement of upper and lower bow limbs of the instant invention is coordinated with a synchronizing cable, but the force applied to the individual linkages is inherently balanced by allowing the leaf spring to freely pivot.

11 Claims, 2 Drawing Sheets

Fig. 4
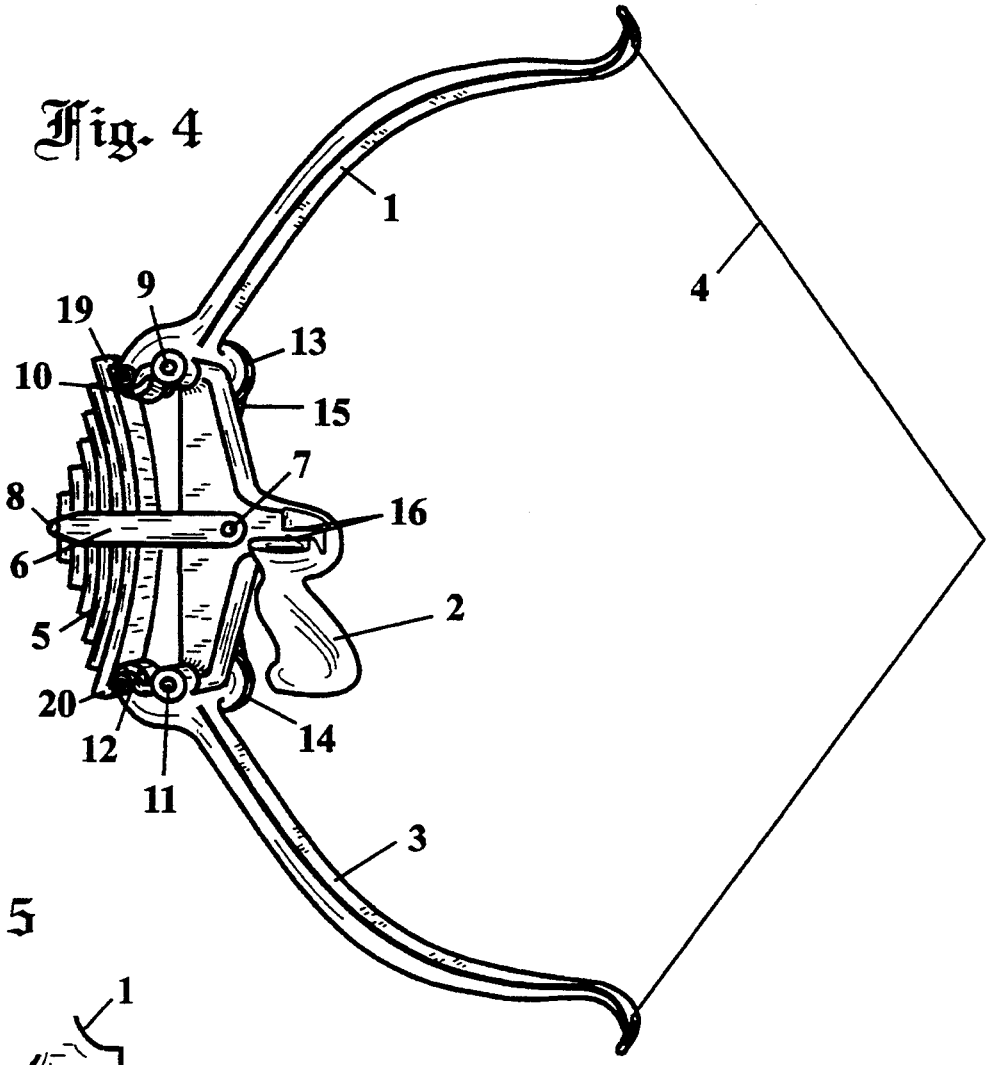
Fig. 5
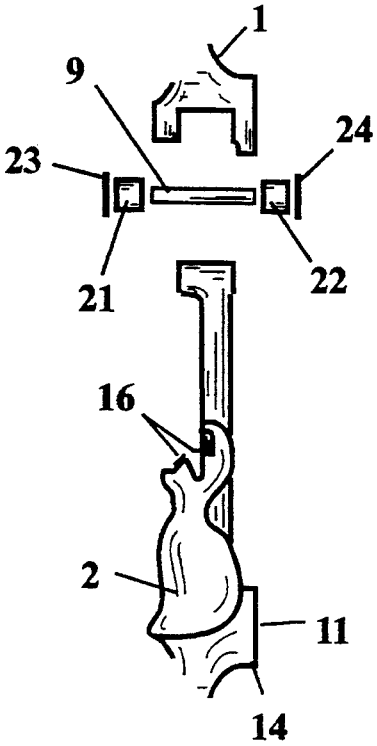
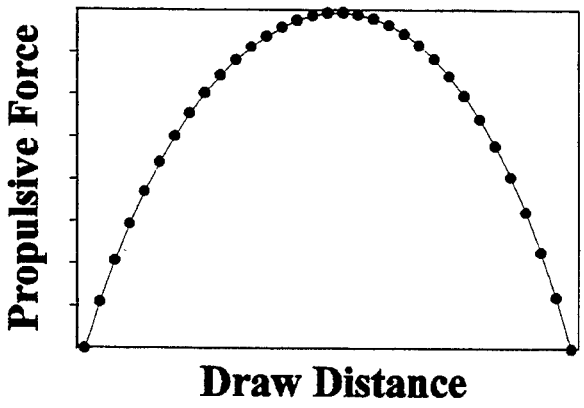
Fig. 6

COMPOUND BOW WITH HIGH POWER AND EXTREME LET-OFF

BACKGROUND OF THE INVENTION

1. Field of The Invention

This invention relates to compound bows, particularly to compound bows with high peak draw forces followed by an extreme reduction in draw force at extension, and apparatus and method therefor.

2. Description of Related Art

A compound bow does not behave like a simple spring when it is drawn. A compound bow requires a great deal of force to pull it at first; the required force then "lets off" after some peak to a more reasonable level. The bow is "compound" in that it has a non-linear force-draw characteristic.

An early American patent on a compound bow was awarded to Holless W. Allen, of Kansas City, Mo., as U.S. Pat. No. 3,486,495, issued in 1969. Mr. Allen's bow represents a considerable departure from previous designs, and the principles he originated have been refined by many others. Modern manufacturers of compound bows, making bows essentially based on Mr. Allen's design, advertise let-offs of up to 65% on bows with a peak draw force around 36 kilograms (80 pounds). Mr. Allen's design uses eccentric wheels at the bow limb ends, with crossing wires between the limb ends to synchronize limb movement. The eccentric wheels provide a variable mechanical advantage as the bow is drawn. The Allen design has been a great commercial success and represents, in its descendent designs, the only type of compound bow generally available on the market. The design has one major weakness: the amount of let-off is fundamentally limited by the design. Several other features also represent weaknesses in the design. For example, the aesthetics of eccentric wheels and multiple crossing cables are poor, the bow is difficult to adjust so that equal forces can be obtained from each limb; and the balance of the bow is generally not at the handle but at a point toward the user. Furthermore, a high proportion of the total weight is located at the limb ends, where the potential for deleterious dynamic effects is greatest. Balance is an important consideration because of its effect on the user's ability to control the arrow release. A center of gravity toward the user will cause the bow to drop slightly tip on release as it pivots around the user's hand, thus causing porpoising of the arrow in flight. Any departure from exact balance of the limb ends will have the same effect. A center of balance forward of the user's hand is generally preferred.

The eccentric-wheel approach is now widely used, but it is not the only method for achieving a compound bow. A second approach is based on the fact that when rotating a cam or lever against a spring, the force imparted by the spring may be divided into a component causing a rotational torque and a second component causing compression of the cam or lever. When the contact point of the cain or lever is in a direct line between the spring and the pivot point of the cam or lever, there is no torque component at all. The force from the spring is completely expended in compressing the cam or lever. If this is taken as the zero angle, then the component of force causing torque as the cam or lever is rotated may be calculated by multiplying the force from the spring by the sine of the angle of rotation. The peak torque component will be at ninety degrees. It must be remembered, however, that a spring generally compresses linearly, causing a variable force as a cam or lever is rotated against it. This principle applied to a compound bow was first patented in the U.S. by George C. Smith, of McKinleyville, Calif., as U.S. Pat. No. 3,812,835, issued in 1974.

Mr. Smith's bow incorporates rotatable limbs pivoted on a handle assembly and bearing against leaf springs mounted at their base on the handle assembly. As the a rotatable limbs pivot on the handle assembly the force from the leaf springs will increase as they are deflected, but the resultant torque will decrease as the angle between spring contact and pivot point is reduced. The mechanical advantage of the bowstring on the arrow it propels also varies as the bow is drawn, making analysis somewhat more difficult, but the end result of Smith's design is a force-draw function with a peak and a subsequent reduction to zero if desired. There is, however, a very fundamental problem with Mr. Smith's novel design. Mr. Smith is aware that any deviation in the force from the springs or geometry of the mechanism will cause one limb to bend more than the other, so synchronizing cables are necessarily incorporated between the two limbs. Unfortunately, however, the attachment points of the coordinating cables depicted in Mr. Smith's patent are clearly at different radii from the pivot point of the rotatable limbs, thus causing the amount of cable "paid out" and "drawn in" during rotation to be quite different for the two cable attachment points. Since the inner attachment point of one limb is directly cabled to the outer attachment point of the other, and vice versa, an equal amount of cable must be paid out and drawn in from both the inner and outer attachment points to allow rotation. When attachment points are at different radii, as in Mr. Smith's configuration, no limb rotation at all is mechanically possible.

A second approach to a compound bow using a spring and rotating lever or cam was made by Robert M. Van House, of Dayton, Ohio, U.S. Pat. No. 4,041,927, issued in 1977. Mr. Van House's design has several distinctive features. Only one spring is used, in this case a piston compressing air or a rubber shear spring, thus assuring that the force exerted on both rotatable limbs is equal. Limb synchronization is accomplished with a single cable routed over forward and after portions of pulley sections attached to the upper and lower rotatable limbs of the bow respectively. Linkages to the spring are adjustable to accommodate different draw lengths, and the spring itself is adjustable by varying the air pressure therein. By placing the spring forward of the handle good balance can be achieved. But the design has a significant weakness in that it does not lend itself to the production of high power bows. If, for example, the object is to design a compound bow with a peak of 36 Kilograms (80 pounds) of draw force, the air spring of Mr. Van House's bow must exert a force of roughly 775 Kilograms (1705 pounds), assuming a bow with a 122 cm. (48 inch) string proportioned as shown in Van House's FIG. 1. This would require a piston air pressure around 60.8 $Kg/cm^2$ (865 $lbs/in^2$), which is not easy to work with in practice. The structure of the linkages and bearing points shown in Van House's FIG. 1 would also need strengthening to withstand the forces applied.

U.S. Pat. No. 4,756,295 issued to Matthew P. Guzzetta of Spring Valley, Calif., in 1988, is very similar in concept to the Van House patent cited above, and suffers from the same defect. Mr. Guzzetta's design is also conceptually attractive but not practical when applied to a high powered bow.

A large amount of energy must be stored in a high powered bow when it is drawn or there cannot be a large amount of energy to ultimately propel the arrow. When an attempt is made to store that energy in a small place, such as in an air or compression spring, then that energy becomes concentrated and high resultant forces develop that must be contained. Friction at bearing surfaces also increases. The primary advantage of the compound bow invented by Allen and refined by many others is that energy storage takes place in the limbs as in a conventional bow, thus distributing the energy over a larger volume.

SUMMARY OF THE INVENTION

Accordingly, an object of this invention is to provide an improved compound bow apparatus and method with extreme let-off and high power.

Another object of this invention is to provide an aesthetically improved compound bow.

Another object of this invention is to provide a compound bow with inherently balanced limbs that require no adjustment.

A further object of this invention is to provide a compound bow with improved dynamic balance and center of gravity.

These and additional objects of the invention are accomplished by storing energy in a leaf spring energy storage device as the bow of the instant invention is drawn. Energy is stored by rotating bearing surfaces mounted on linkages attached to upper and lower bow limbs into a leaf spring in a manner that causes a portion of the force from the leaf spring which is proportional to the rotation angle to be absorbed as compression by the linkage, with the remainder causing torque on the upper and lower bow limbs. The movement of upper and lower bow limbs of the instant invention is coordinated with a synchronizing cable, but the force applied to the individual linkages is inherently balanced by allowing the leaf spring to freely pivot.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements. The representations in each of the figures is diagrammatic and no attempt is made to indicate actual scales or precise ratios. Proportional relationships are shown as approximations.

FIG. 4 is a left oblique view of an exemplary embodiment of the essential elements of the instant invention showing the relationship of elements relative to one another as the bow is drawn.

FIG. 5 is an exploded view of the bearing system for the upper limb of the exemplary embodiment of the instant invention.

FIG. 6 is a diagram showing the relationship between propulsive force and draw distance for an exemplary embodiment of the instant invention.

DESCRIPTION OF THE PREFERRED EMBODIMENTS

Before proceeding with the Detailed Description, the parts indicated on the drawings by numerals are identified below to aid in the reader's understanding of the present invention.

1. Upper limb.
2. Handle and riser assembly.
3. Lower limb.
4. Bowstring.
5. Leaf spring.
6. Spring retainer.
7. Spring retainer pin.
8. Spring retainer pivot bar.
9. Upper limb pivot pin.
10. Spring follower needle bearing.
11. Lower limb pivot pin.
12. Spring follower needle bearing.
13. Upper synchronizing pulley.
14. Lower synchronizing pulley.
15. Synchronizing cable.
16. Arrow rests.
17. Upper synchronizing cable ball.
18. Lower synchronizing cable ball.
19. Spring follower stop.
20. Spring follower stop.
21. Needle bearing.
22. Needle bearing.
23. "O" ring.
24. "O" ring.

Figure 1:
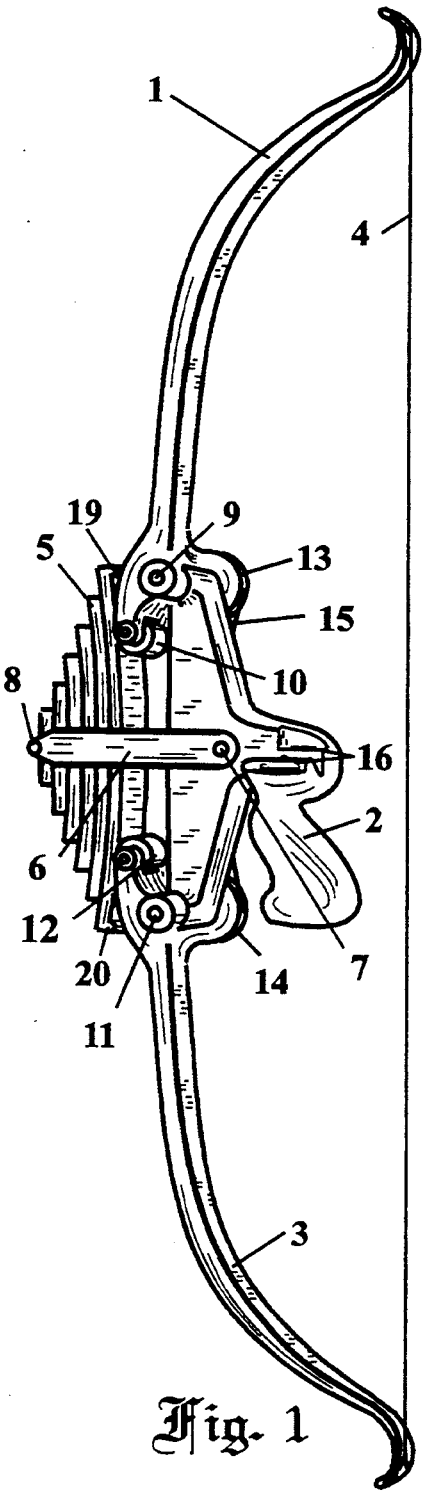
FIG. 1 is a left oblique view of an exemplary embodiment of the essential elements of the instant invention showing the relationship of elements relative to one another.
Figure 2:
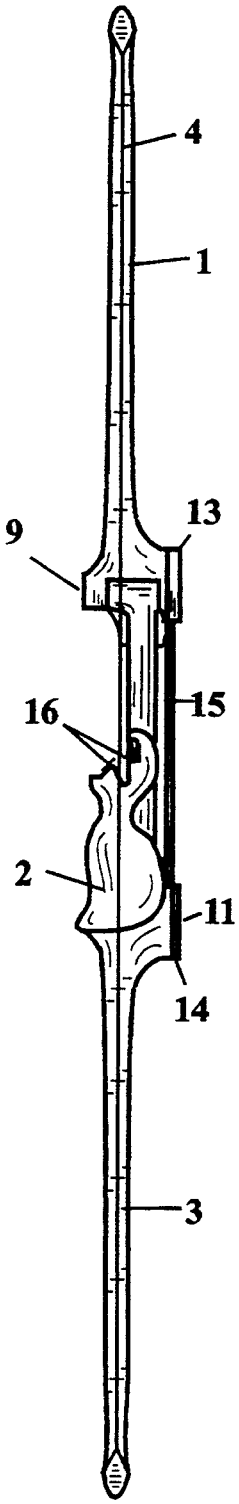
FIG. 2 is a rear view of an exemplary embodiment of the essential elements of the instant invention showing the relationship of elements relative to one another.
Figure 3:
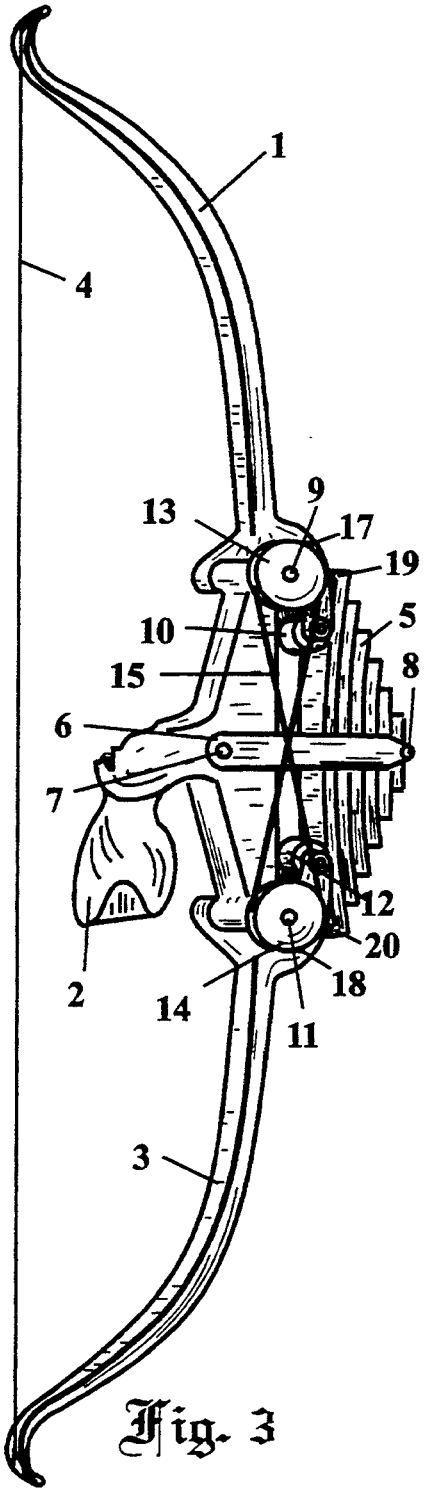
FIG. 3 a right oblique view of an exemplary embodiment of the essential elements of the instant invention showing the relationship of elements relative to one another.

FIGS. 1, 2, and 3 show left oblique, rear, and right oblique views, respectively, of an exemplary embodiment of the present invention in which like numerals in different figures represent the same structures or elements. Referring to FIGS. 1, 2, and 3, 1 is an upper limb, 2 is a handle and riser assembly, and 3 is a lower limb. The outer tips of upper limb, 1, and lower limb, 3, are connected by a bowstring, 4. A leaf spring, 5, is held sprung against elements of the upper and lower limbs to be identified below by spring retainer, 6, which is pinned to handle and riser assembly, 2, by spring retainer pin, 7. Spring retainer pivot bar, 8, connects the two sides of spring retainer, 6, to form an essentially "U" shaped structure. Spring retainer pivot bar, 8, has a circular cross section that fits into a similar depression (not shown) on leaf spring, 5, thereby allowing leaf spring, 5, the freedom to pivot within spring retainer, 6. In the preferred embodiment of the instant invention a peak draw force of 36 Kilograms (80 pounds) is a design goal, so leaf spring, 5, must be capable of producing a force of approximately 2514 kilograms (5530 lbs) at the peak of draw force, given the relative dimensions shown in the figures and assuming a bowstring length of 102 centimeters (40 inches). As will be seen below, when the instant invention is drawn beyond the peak to a point of reduced propulsive force the forces on the spring retainer increase by some function that is characteristic to the leaf spring used. Spring retainer, 6, spring retainer pin, 7, and spring retainer pivot bar, 8, must all be designed to be able to withstand these forces.

Leaf spring, 5, and the other moldable components of the instant invention have been successfully fabricated using a process described in co-pending application Ser. No. 07/919,850 entitled *Injection of Molding Material Into Molds that May Contain Cores and/or Fibers*, invented by William Bradford Cushman. The leaves to form leaf spring, 5, were molded from epoxy and "S" glass, using approximately 76% glass to epoxy by weight. Eight leaves were used, each with a rectangular cross section of approximately 9.8 millimeter (0.386 inch) by 20.5 millimeter (0.808 inch).

Upper limb, 1, pivots on bearings contained within handle and riser assembly, 2, by way of upper limb pivot pin, 9. As upper limb, 1, pivots, spring follower needle bearing, 10, causes the upper portion of leaf spring, 5, to be deflected. Spring follower needle bearing, 10, and the lower spring follower needle bearing, 12, are comprised of a needle bearings with thickened outer races such as are commonly used as track rollers. Lower limb, 3, operates in a similar fashion, pivoting on lower limb pivot pin, 11, causing spring follower needle bearing, 12, to deflect leaf spring, 5. Upper synchronizing pulley, 13, is integral to upper limb, 1, and lower synchronizing pulley, 14, is integral to lower limb, 3. Synchronizing cable, 15, rides on upper synchronizing pulley, 13, and lower synchronizing pulley, 14, and is crossed to cause the upper and lower limbs to deflect by the same angular displacement relative to the handle and riser assembly, 2, when the bowstring, 4, is drawn. Arrow rests, 16, provide a means of guiding an arrow shaft being shot from the instant invention without contacting the fletching on the arrow. Upper synchronizing cable ball, 17, and lower synchronizing cable ball, 18, fit in depressions in upper and lower synchronizing pulleys, 13 and 14 (not shown) to maintain alignment of the upper and lower limbs. Spring follower stops, 19 and 20, prevent spring follower needle bearings, 10 and 12, respectively, from traveling quite to points where the force vectors from leaf spring, 5, point directly at the upper and lower pivot pins, 9 and 11; thereby insuring that the upper and lower limbs, 1 and 3, will return to the undrawn position when the bowstring, 4, is released.

FIG. 4 shows a preferred embodiment of the instant invention when it is drawn. The handle and riser assembly, 2, is held essentially stationary when the instant invention is used. As the bowstring, 4, is drawn both the upper and lower limbs, 1 and 3, rotate approximately 32 degrees for a draw distance of roughly 55 centimeters (21.65 inches). When the instant invention is drawn to this extent the force vectors from leaf spring, 5, point very nearly at the upper and lower pivot pins, 9 and 11, causing the portion of each limb between the respective pivot pins, 9 and 11, and spring follower needle bearings, 10 and 12, to be compressed with almost all of the force from leaf spring, 5. The small residual forces from leaf spring, 5, that are expressed as torque on the upper and lower limbs, 1 and 3, act to rotate the upper and lower limbs and straighten bowstring, 4. The length of bowstring, 4, can be adjusted over a small range to accommodate different draw lengths. Adjustment of bowstring length to achieve different draw forces at extension is a matter of personal preference.

The distance between pivot pins and spring follower needle bearings on both the upper and lower limbs is the same, the distance between pivot pins and limb tips is the same on both upper and lower limbs, and the angle made at the pivot pins between limb tips and spring follower needle bearings is the same for both upper and lower limbs. Leaf spring, 5, is free to pivot against spring retainer pivot bar, 8, which guarantees that the force applied to the spring follower needle bearings on both upper and lower limbs is exactly balanced at all times. The symmetry between forces acting on the upper and lower limbs, and their matched geometry insures that the torque applied to the ends of bowstring, 4, is also matched—thus causing the propulsive forces imparted to an arrow by the bowstring of the instant invention to be evenly applied. Propelling the arrow without vertical components of force from the bowstring eliminates any tendency of the arrow to "porpoise" and ensures that all available energy is directed toward forward flight of the arrow.

FIG. 5 is an exploded detail view of the upper limb pivot bearing assembly. Needle bearings are used throughout the design of the instant invention because of their greater ability to withstand high loadings while keeping friction minimal. In FIG. 5, 1, is a section of the upper limb, and 9 is the upper limb pivot pin. A preferred practice is to press-fit the pivot pins into holes provided in the upper and lower limbs. Needle bearings, 21 and 22, are press-fit into holes provided in handle and riser assembly, 2. In the preferred embodiment of the instant invention handle and riser assembly, 2, has a total of four needle bearings press-fit into it, two for the upper limb pivot pin and two for the lower limb pivot pin. All needle bearings should be packed with a good lubricating grease when the instant invention is assembled. "0" rings, 23 and 24, fit in recesses (not shown) between the outer forces of handle and riser assembly, 2, and inner faces of the yokes of upper and lower limbs, 1 and 3. "0" rings, 23 and 24, should be compressed slightly when the instant invention is assembled to form a grease and water seal. If proper seals are achieved the preferred embodiment of the instant invention can remain maintenance free for many years. FIG. 6 shows a plot of propulsive force as a function of draw distance. The distinctive feature of FIG. 6 is a peak of propulsive force followed by a let-off to zero propulsive force at full draw. In practice the design of any embodiment of the instant invention must be such that draw to zero propulsive force point, beyond the peak draw force, is never accomplished. Drawing the bow of the instant invention to this point would eliminate any initial forward acceleration on an arrow, and the bow could not shoot. In fact, drawing to a point of zero propulsive force is rather uncomfortable for the archer because all of the weight of the bow is then resting on the archer's extended left arm (assuming a right-handed archer). When a bow is normally drawn some of the draw force acts to support the weight of the bow on the left arm. Some experimentation with different bowstring lengths can determine a comfortable draw force for a particular individual. A rather light 2–4 kilogram (4.4–8.8 pounds) draw is enough propulsive force to ensure a snappy initial acceleration of the arrow and a firm feel to the bow, without being high enough to cause strain while aiming.

Obviously, many modifications and variations of the present invention are possible in light of the above teachings. It is therefore to be understood that the specific embodiment described is by way of illustration only and that the invention is not necessarily limited thereto, since alternative embodiments and operating techniques will become apparent to those skilled in the art in view of the disclosure. Accordingly, within the scope of the appended claims, the invention may be practiced otherwise than as specifically described without departing from the spirit of the described invention.

Having described the invention, what is claimed as new and desired to be secured by Letters Patent is:

1. A compound bow comprising:

(a) a riser assembly having a handle portion and upper and lower ends;

(b) an upper limb having a distal end, a proximal end, and an upper pivot intermediate the distal and proximal ends, said upper limb being pivotably attached to the upper end of the riser assembly at the upper pivot;

(c) a lower limb having a distal end, a proximal end, and a lower pivot intermediate the distal and proximal ends, said lower limb being pivotably attached to the lower end of the riser assembly at the lower pivot;

(d) a bow string attached to both the upper and lower limbs at their distal ends;

(e) a leaf spring retention device attached to the riser assembly proximate the handle;

(f) a single leaf spring having upper and lower ends, the leaf spring being attached to the leaf spring retention device such that the leaf spring is freely pivotable about the leaf spring retention device, the proximal ends of the upper and lower limbs being in contact with the respective upper and lower ends of the leaf spring to provide a spring force to the limbs and bowstring when the limbs are pivoted; and (g) a synchronizing cable attached to the upper and lower limbs for synchronizing the movement of the upper and lower limbs.

2. The compound bow of claim 1 with either a single leaf or a plurality of leaves in said leaf spring.

3. The compound bow of claim 1 wherein said leaf spring is made of composite material.

4. The compound bow of claim 1 wherein said handle and riser assembly is made of composite material.

5. The compound bow of claim 1 wherein said upper and lower limbs are made of composite material.

6. The compound bow of claim 1 with an arrow rest mounted onto said riser assembly.

7. The compound bow of claim 1 wherein said proximal ends of said upper and lower limbs contact the respective upper and lower ends of said leaf spring through needle bearings.

8. The compound bow of claim 7 wherein seals are provided to hold lubricating materials in said needle bearings.

9. The compound bow of claim 1 wherein said upper and lower limbs are pivotably attached to said riser assembly with needle bearings.

10. The compound bow of claim 9 wherein seals are provided to hold lubricating materials in said needle bearings.

11. The compound bow of claim 1 wherein said leaf spring has stops to prevent said proximal ends of said upper and lower limbs from traveling to a point where the force vectors from said leaf spring pass in a direct line through the contact points between said proximal ends of said upper and lower limbs and said leaf spring and said upper and lower limb pivoting points.

* * * * *